US008246290B2

(12) United States Patent
May et al.

(10) Patent No.: US 8,246,290 B2
(45) Date of Patent: Aug. 21, 2012

(54) CARTON FEEDER HAVING FRICTION REDUCING SUPPORT SHAFT

(75) Inventors: Kevin T. May, Kennesaw, GA (US); Cory E. Hawley, Austell, GA (US)

(73) Assignee: Graphic Packaging International, Inc., Marietta, GA (US)

( * ) Notice: Subject to any disclaimer, the term of this patent is extended or adjusted under 35 U.S.C. 154(b) by 448 days.

(21) Appl. No.: 12/238,970

(22) Filed: Sep. 26, 2008

(65) Prior Publication Data

US 2009/0087296 A1 Apr. 2, 2009

Related U.S. Application Data

(60) Provisional application No. 60/995,694, filed on Sep. 27, 2007.

(51) Int. Cl.
*B65G 59/06* (2006.01)

(52) U.S. Cl. ..... 414/797.5; 271/166; 414/797.8

(58) Field of Classification Search ..... 271/11, 271/166, 221, 3.05, 3.07, 35; 414/797.4, 414/797.5, 797.6, 797.7, 797.8, 798, 798.1
See application file for complete search history.

(56) References Cited

U.S. PATENT DOCUMENTS 2,133,263 A * 10/1938 Wolff ..... 414/788.4
2,449,690 A * 9/1948 Chapman ..... 271/11
3,655,072 A * 4/1972 Bateman ..... 414/788.5
3,841,623 A * 10/1974 McCarthy et al. ..... 271/126
4,232,860 A * 11/1980 Brown ..... 271/119
4,513,878 A 4/1985 Hartness et al.
4,729,282 A 3/1988 Kasdorf
4,884,797 A 12/1989 Svyatsky
(Continued)

FOREIGN PATENT DOCUMENTS

DE 906 887 C 2/1954
(Continued)

OTHER PUBLICATIONS

International Search Report—PCT/US2008/077852, Sep. 26, 2008.
(Continued)

*Primary Examiner* — Gregory Adams
(74) *Attorney, Agent, or Firm* — Womble Carlyle Sandridge & Rice, LLP

(57) ABSTRACT

A carton feeder assembly is disclosed for selecting or picking carton blanks from the end of a stack of blanks in a magazine. The assembly includes a magazine and conveyor for moving stacks of carton blanks toward a carton feeder assembly. A support shaft assembly is disposed at the downstream end of the magazine and includes a support shaft against which the forwardmost carton blank in the stack leans and rests to support the stack of carton blanks. The support shaft is eccentrically rotatably mounted and driven by a motor so that the support shaft oscillates rapidly as it is rotated. This motion of the support shaft keeps the forwardmost blank of the stack spaced slightly from and out of contact with the support shaft for a significant majority of the time, thus reducing substantially the average friction between the forwardmost blank and the support shaft. Thus, the forwardmost blank can gripped with suction cups of the feeder assembly, which can then be moved to slide the forwardmost blank from beneath the support shaft and off of the stack of blanks with very little frictional resistance. The suction cups thus stay attached to the blank and do not tend to slide off due to shear forces developed in overcoming frictional resistance.

31 Claims, 5 Drawing Sheets

U.S. PATENT DOCUMENTS

| | | | | |
|---|---|---|---|---|
| 4,930,764 | A * | 6/1990 | Holbrook et al. | 271/119 |
| 5,213,319 | A | 5/1993 | Crowe et al. | |
| 5,464,202 | A * | 11/1995 | Capdeboscq | 271/11 |
| 5,562,581 | A | 10/1996 | Roberto et al. | |
| 5,860,269 | A * | 1/1999 | Takahashi et al. | 53/64 |
| 6,164,432 | A * | 12/2000 | Monsees | 198/459.4 |
| 6,311,457 | B1 | 11/2001 | May et al. | |
| 6,550,608 | B1 | 4/2003 | Brown et al. | |
| 6,626,633 | B2 * | 9/2003 | Jendzurski et al. | 414/797.9 |
| 6,698,748 | B1 * | 3/2004 | Crowley | 271/98 |

FOREIGN PATENT DOCUMENTS

| | | |
|---|---|---|
| EP | 0 816 268 A2 | 1/1998 |
| JP | 45-28854 | 9/1970 |
| JP | 62-16435 | 4/1987 |
| JP | 1-317930 | 12/1989 |
| JP | 4-7543 | 1/1992 |

OTHER PUBLICATIONS

Written Opinion—PCT/US2008/077852, Sep. 26, 2008.

GPI System II—Feeder System for System II High Speed Wrap Machine—Prior to Sep. 2006 (2 pages).

GPI Marksman 1400 Version 2—Prior to Sep. 2006.

GPI Autoflex 1500—Prior to Sep. 2006.

GPI Quickflex 600—Prior to Sep. 2006 (2 pages).

GPI Marksman 2100 Version 1—Prior to Sep. 2006.

GPI Marksman 2100 Version 2—Prior to Sep. 2006.

GPI Marksman 1400 Version 1—Prior to Sep. 2006 (2 pages).

Office Action from co-pending Japanese Patent Application No. 2010-527182 dated Nov. 28, 2011.

Supplementary European Search Report for EP 08 83 3748 dated Jun. 14, 2012.

* cited by examiner

CARTON FEEDER HAVING FRICTION REDUCING SUPPORT SHAFT

RELATED APPLICATIONS

Benefit of the filing date of U.S. provisional patent application Ser. No. 60/995,694 filed on Sep. 27, 2007 is hereby claimed, the disclosure of which is hereby incorporated by reference in its entirety.

TECHNICAL FIELD

This disclosure relates generally to continuous motion packaging machines for packaging articles such as bottles and cans into paperboard or corrugated board cartons. More particularly, the disclosure relates to feeder assemblies of continuous motion packaging machines for picking individual paperboard or corrugated board blanks from a stack of blanks and feeding them sequentially to downstream work stations of the packaging machine to be filled with or erected around articles.

BACKGROUND

Feeders that selectively deliver articles to a work zone in a manufacturing operation are well known. For example, in the packaging industry, the packaging of food or beverage containers, such as bottles or cans, into cartons requires high speed feeders that deliver carton blanks successively to a conveyor, which then delivers the blanks to the next work station. The carton blanks generally are substantially flat, stiff paperboard or corrugated board items that previously have been fabricated from rolled stock by cutting blanks from the stock and scoring features, such as fold lines and score lines, into the blanks. Similar feeders also are employed in many other industries, such as in the magazine and publications industries, where the continuous sequential feeding of relatively flat articles from a stack or queue is required. U.S. Pat. No. 6,550,608, owned by the assignee of the present application, discloses a carton feeding system for a packaging machine that exemplifies many of the attributes mentioned above. This patent is hereby incorporated by reference in its entirety.

The term "carton feeder" commonly is used to refer to feeders that select and deliver carton blanks to a work zone in high speed continuous packaging operations. Many different types of carton feeders are used in the packaging industry, and have varying features depending upon the specific use and application requirements. It is common, however, for carton feeders to include some common structural and operation features. For example, most carton feeders used in the packaging industry are part of a carton feeding system, which can include a device for delivering stacks of carton blanks to a carton magazine. The carton magazine stores sufficient numbers of carton blanks and includes a conveyor system for conveying the blanks toward the feeder. At the feeder, individual carton blanks are sequentially selected or picked from the forwardmost end of the stack and delivered to downstream workstations of the packaging machine.

A carton magazine typically supports carton blanks on edge in a horizontal stack of hundreds or thousands of blanks, so that each carton blank rests on an edge with one face of the blank generally facing in a downstream direction toward the feeder. The magazine can include a conveyor, such as moving chain flights, on which the stack of blanks rests, and which progressively moves the carton blanks toward the feeder as the feeder progressively picks carton blanks from the forwardmost end of the stack. Rails on either side of the conveyor may maintain the stack of blanks centered or otherwise properly positioned on the conveyor. The stack of carton blanks generally is tilted, at least in the vicinity of the feeder, slightly towards the feeder to insure that the blanks maintain their upright orientations.

At a selection zone of the carton feeder, which is disposed at the most downstream end or position of the magazine, the first exposed carton in the stack contacts and is supported along its top edge by, for example, a bar or a shaft having rollers or by mechanical clips or tabs. This top edge leans against the rollers of the shaft, or against the bar or clips, depending upon the elements used, to support the upper edge portion of the stack of blanks. The bottom edge of the forwardmost blank in the magazine also contacts and is held by mechanical elements such as upstanding clips or tabs. The exposed forwardmost blank in the stack, and the stack itself, is thus supported in the proper position for selection of the forwardmost blank by the feeder. In this position, the forwardmost carton blank in the stack is urged with significant force against the rollers, bar, or clips, either by the weight of the stack of blanks, or by the force of the conveyor moving the stack forward, or both.

In one feeder system, a long horizontally oriented section of the magazine, which may support and convey thousands of carton blanks, terminates at a short downwardly oriented chute section of the magazine, sometimes referred to as the waterfall. Shorter stacks of carton blanks are conveyed from the horizontally oriented portion of the magazine into the chute, where they come to rest against the aforementioned shaft, clips, and/or tabs with the exposed face of the forwardmost blank always exposed so that it may be selected from the stack.

A common selection mechanism for a carton feeder is a vacuum system. This system includes a group of spaced vacuum cups on a pick arm assembly that are controlled to move into engagement with the exposed face of the forwardmost blank in the magazine, attach with a vacuum seal, pull the forwardmost blank from the stack, and slide the blank off of the stack for delivery to downstream stations of the packaging machine. The vacuum system includes vacuum lines, valves, and pumps that are operated in timed relationship, so that a vacuum is drawn on the face of the blank at the desired moment and held until the carton blank is released by the vacuum system. Once the forwardmost carton blank is contacted by the vacuum cups, the pick arm assembly pulls the carton blank forwardly away from the magazine a short distance until one edge of the carton blank is pulled over and away from contact with the clips or tabs holding the edge in position. The pick arm assembly then may be rotated, or otherwise moved, to slide the selected blank from beneath the shaft, clips, and/or tabs at the other edge of the blank and off of the end of the stack. The selected blank is then moved to the next work station, usually a conveyor assembly. At this position, the carton blank is released by the vacuum system and the carton is moved by the conveyor to the next area, where the carton either is folded around a group of containers, or erected, or positioned over a group of containers, depending upon the type of carton blank used. The pick arm assembly may include a plurality of vacuum cup assemblies that select carton blanks from the stack in rapid succession.

Selection and removal of the single forwardmost or first carton blank from the magazine requires that the vacuum cup attachment and forces applied to pull the carton blank forward and then slide it from beneath the clips and off of the stack are sufficient to overcome the mechanical forces that hold the carton blank in the magazine. Usually these forces include friction that is induced by the weight of the carton stack and/or the magazine chain conveyor pressing the forwardmost carton against the rollers and/or clips at the end of the magazine. If the vacuum is insufficient or the pulling forces are insufficient to overcome this friction, the carton blank will not be selected correctly. For The force of the vacuum attaching the vacuum cups to the face of the forwardmost carton is strongest in a direction perpendicular to the face of the blank; that is, along the axis of the vacuum cup. Conversely, the force is weakest in a direction parallel to the face of the blank or transverse to the axis of the vacuum cup. As a consequence, one edge of the forwardmost blank often is pulled easily over and away from the clips holding it in place at the end of the magazine. However, when the pick arm assembly rotates the vacuum cups to slide the blank off of the stack, the friction between the blank and the bar and/or clips holding the opposite edge portion of the blank can be sufficiently great to overcome the force of the vacuum. This can cause the vacuum cups to slide or slip off the face of the blank, particularly during high speed operation of the feeder. The result can be that a carton blank is not picked, or selected, from the magazine, or that a carton blank is only partially separated from the magazine, resulting in a system jamb and an operational stoppage.

Therefore, there is an advantage in reducing the frictional forces that are exerted on the forwardmost carton blank in a magazine in these types of feeder systems, so that the gripping force of the vacuum cups needed to select the first carton reliably also is reduced and/or controlled. Prior feeder systems have addressed this issue by using small spaced clips instead of bars at the end of the magazine to hold the forwardmost carton blank at its edges, thus reducing the contact area between the carton edge and the mechanical element. Other methods and elements used to reduce the frictional forces between carton blanks and the mechanical structures holding them in place at the end of the magazine include freewheeling rollers placed along a support shaft instead of clips or bars. Sometimes the rollers themselves can be positively driven by a shaft, in order to reduce further the force needed to select the first carton. Another prior feeder system includes a movable support bar synchronized with the pick arm and suction cups such that just before a blank is to be slid off the stack at the end of the magazine, the support bar moves quickly a short distance toward the stack of blanks and back again to toss the stack briefly backward a short distance. The forwardmost blank is then slid from beneath the support bar as the stack falls back toward the support bar, a time when friction allegedly is reduced.

A need exists for an improved system for insuring that the forwardmost carton blank of a stack in the magazine is reliably selected and removed from the stack, particularly during high speed operation of the packaging machine. It is to the provision of such a system that the present invention is primarily directed.

SUMMARY

Briefly described, the present invention, in one embodiment thereof, includes a carton feeder and carton magazine assembly having, at the downstream end of the magazine, a support shaft assembly. The support shaft assembly includes a driven eccentrically rotating support shaft against which the forwardmost blank in a stack of carton blanks rests and by which the stack is supported. Several freewheeling bushings or rollers preferably are mounted at spaced intervals along the support shaft. The support shaft rotates relatively rapidly and oscillates, simultaneously, against the forwardmost blank of the carton stack. This motion of the support shaft maintains the forwardmost carton blank spaced slightly from and out of contact with the rollers of the support shaft for the great majority of each revolution of the support shaft. During this time, there is virtually no friction between the forwardmost blank and the rollers of the support shaft. Thus, the average frictional force between the blank and the rollers of the support shaft is significantly reduced. The eccentrically rotating motion of the support shaft against the forwardmost blank also vibrates and "shakes down" the stack of blanks, reducing friction between successive blanks in the stack and helping to keep the blanks aligned. As a result, significantly less force is required for suction cups of the pick arm assembly to slide the forwardmost carton blank from beneath the support shaft and off of the stack. Consequently, mispicks of carton blanks and the resulting machine jambs and down time are virtually eliminated.

The support shaft assembly includes the generally cylindrical support shaft body with spaced freewheeling rollers that extends across the downstream end of the carton magazine to support a stack of carton blanks as described. Cylindrical bosses, smaller in diameter than the support shaft body, project axially from each end of the support shaft body. The cylindrical bosses are axially aligned with each other, but their axes are offset a small distance from the axis of the support shaft body. The cylindrical bosses are rotatably journaled by bearing assemblies that are supported by the frame of the carton magazine. One of the cylindrical bosses is driven by an electric induction motor that is controlled by a machine controller. Thus, upon activation of the motor, it will be seen that the support shaft body and its rollers are caused to rotate eccentrically and not concentrically about the axes of the cylindrical bosses, and thus the support shaft oscillates as it rotates. The support shaft body has milled balancing kerfs at various locations along its "high side" to insure that the support shaft is balanced as it rotates eccentrically and does not shake in its bearings because of the eccentric nature of its rotation.

The eccentric rotation and consequent oscillation of the support shaft and its rollers causes the stack of carton blanks to move rearwardly, that is, away from the carton feeder, a short distance as the high side of the support shaft body and the freewheeling rollers thereon move toward the stack during each eccentric revolution. When the high side of the support shaft begins to rotate away from the stack, the rollers move out of contact with the forwardmost carton blank and the stack begins to fall back toward the support shaft under the weight of the stack. However, if the support shaft is rotated at a sufficiently high rate such as, for example, 1500 revolutions per minute, the stack will not have time to fall back into contact with the rollers of the support shaft before the next rotational cycle when it is again urged rearwardly by the support shaft rollers. As a result, the forwardmost carton blank of the stack is out of contact with the rollers of the support shaft for most of the time, which can be as much as ninety or ninety-five percent of the time. Only when the "high side" of the support shaft rotates toward the stack do its rollers contact the forwardmost blank for a short time to nudge the stack rearwardly once again.

When suction cups of the feeder assembly grasp the forwardmost carton blank of the stack, pull its bottom edge from behind the upstanding support tabs, and begin to slide the blank from beneath the support shaft and off of the stack, the average friction between the face of the blank and the support shaft, and the friction between successive blanks in the stack, is significantly reduced compared to that present with prior art support clips and bars. Thus, the forwardmost blank of the stack slides easily from beneath the support shaft and off of the stack and the suction cups do not tend to slip off of the face of the blank due to shear forces generated in overcoming friction, as has been common in the past. In one embodiment, the support shaft is rotated in the same direction that the carton blanks are to be slid off of the stack, which imparts to the forwardmost carton a slight force in that direction. This slight force assists the suction cups of the pick arm assembly to slide blanks from the end of the stack and thus further insures against machine jambs and down time.

Thus, a carton feeder and magazine assembly is now provided that successfully addresses shortcomings of the prior art. The assembly will be better understood upon review of the detailed description set forth below taken in conjunction with the accompanying drawing figures, which are briefly described as follows.

DETAILED DESCRIPTION

Figure 1:
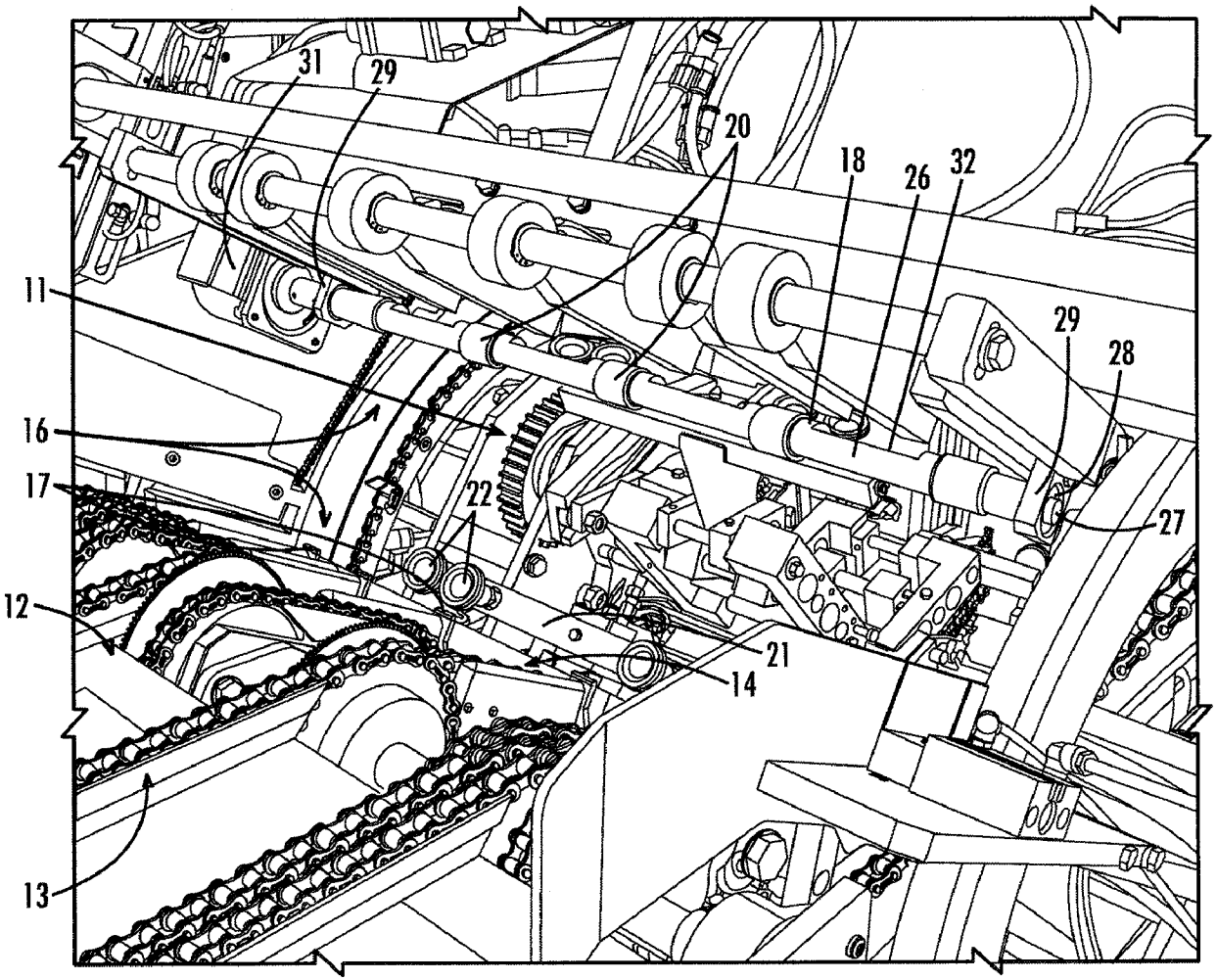
FIG. 1 is a perspective view, looking downstream toward the feeder assembly, of the end portion of a carton magazine illustrating aspects of the invention in one preferred embodiment thereof.

Referring now in more detail to the drawing figures, wherein like reference numerals indicate like parts throughout the several views, FIG. 1 is a perspective view of a carton feeder and magazine system according to the invention looking downstream from the carton magazine toward the feeder assembly. The feeder assembly, generally indicated at 11, is similar in construction and operation to that disclosed in the fully incorporated U.S. Pat. No. 6,550,608, owned by the assignee of the present invention. As such, the feeder assembly itself need not be described here in great detail. In general, however, the feeder assembly 11 is located at the end 16 of the carton magazine 12. The feeder assembly is configured and operates to feed carton blanks from the end of a stack of blanks supported on the magazine 12 into an overlying relationship with a series or groups of articles, such as beverage cans or bottles, passing through an article packaging machine, where the articles are packaged into cartons. The feeder assembly 11 is a rotary type carton feeder having a series of carton engaging assemblies, each including a vacuum cup bar 21 on which is mounted a plurality of spaced apart vacuum cups 22 connected to a vacuum system.

The carton magazine 12 has a generally horizontal section 13 with rails and conveyor chain flights for supporting a stack of hundreds or thousands of carton blanks resting on edge on the magazine. The chain flights move in a downstream direction to convey the stack of cartons on the magazine toward the carton feeder assembly. A downwardly angled chute section of the magazine, sometimes referred to as the waterfall, is disposed at the downstream end of the magazine adjacent to the feeder assembly 11. The chute section of the magazine has a discharge end, generally indicated at 16, adjacent the feeder assembly where the forwardmost carton blank of a stack of blanks in the magazine is held in position with its face exposed to the feeder assembly for selection.

An array of upstanding tabs or clips 17 are disposed along the bottom edge of the discharge end 16 of the magazine and a support shaft 18, constructed and operating according to the present invention, extends across the discharge end near its upper extent. As a stack of carton blanks is progressively conveyed toward the discharge end 16 of the magazine, the bottom edge of the forwardmost blank of the stack is engaged by the upstanding tabs 17 and the upper portion of the forwardmost blank of the stack leans against and is supported by the support shaft 18. The weight of the stack of blanks is thus supported by the upstanding tabs 17 and the support shaft 18 with the forwardmost carton blank of the stack positioned with its surface facing and exposed to the carton feeder 11.

The carton feeder 11 sequentially selects or picks the exposed forwardmost carton blanks from the end of the stack on the magazine and delivers them, in rapid succession, to downstream workstations of the packaging machine. More specifically, a vacuum cup bar 21 of the feeder assembly is rotated toward the forwardmost blank in the stack until the vacuum cups 22 of the bar 21 engage the exposed surface of the forwardmost blank near its bottom edge. The vacuum system applies a vacuum to the vacuum cups 22, which attaches the vacuum cups to the surface of the forwardmost blank. The vacuum cups 22 are then moved back a short distance in a direction generally perpendicular to the face of the blank, which pulls the bottom edge of the forwardmost blank from behind the upstanding clips 17 to free the bottom edge of the blank. With the bottom edge of the forwardmost blank freed from the stack, the feeder assembly 11 rotates the vacuum bar 21 and its vacuum cups 22 in a downward direction, which pulls the forwardmost blank downwardly to slide it from beneath the support shaft 18 and off of the stack to be delivered to downstream workstations of the packaging machine. This process is repeated at relatively high speeds during operation of the packaging machine to select and feed carton blanks from a stack in the magazine in rapid succession to downstream workstations, where they are erected around or otherwise packaged with articles such as beverage cans or bottles.

According to the present invention, the support shaft 18 against which the forwardmost blank of the stack rests, comprises an elongated generally cylindrical body 26 that extends across the discharge end 16 of the magazine 12, and that has an axis. A series of bushings or rollers are mounted at spaced intervals along the length of the body 26 and each roller is freely rotatable about the body 26 and thus may be said to be freewheeling. A cylindrical boss 27 projects from each end of the body 26 and each boss 27 is rotatably journaled by a bearing 28 mounted in a support 29. The boss on the right hand side of the support shaft 18 in FIG. 1 is coupled to an induction motor 31 that, when activated, rotates the boss and thus rotates the support shaft 18.

Each of the cylindrical bosses 27 at the ends of the support shaft body 26 is smaller in diameter than the support shaft body 26 and has an axis that is offset a predetermined relatively small distance from the axis of the support shaft body, but that is aligned with the axis of the cylindrical boss at the other end of the support shaft body. Thus, when the support shaft 18 is rotated by the induction motor 31, the support shaft does not rotate concentrically about its axis, but rather rotates eccentrically about the axes of the cylindrical bosses. The surface of the support shaft body 26 and the surfaces of the freewheeling rollers 20 thus oscillate toward and away from a stack of carton blanks on the magazine as a result of the rotation of the support shaft.

A series of milled balancing kerfs 32 are formed along the length of the support shaft body 26 on its "high side" in order to remove a sufficient amount of material to balance the support shaft as it rotates eccentrically. The determination of how much material and weight to remove from the shaft body 26 can be made with any of numerous commercially available computer assisted drawing (CAD) software programs well known to those of skill in the art. The balancing of the support shaft is important since, in operation, it is rotated at a high rate such as, for instance, 1500 revolutions per minute. Without proper balancing, the support shaft 18 would tend to shake or vibrate violently within its bearings 28.

Figure 2:
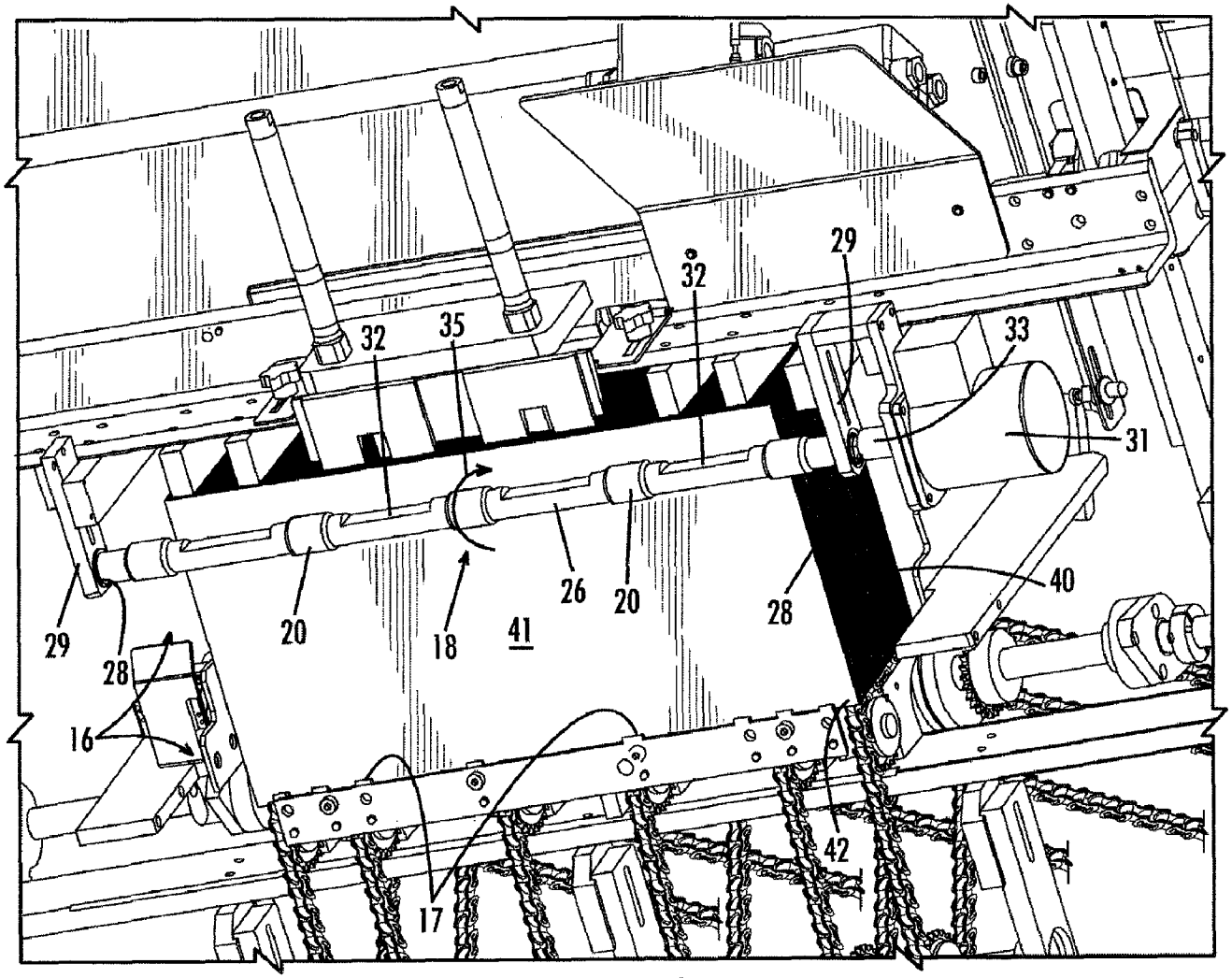
FIG. 2 is a perspective view, looking upstream, of the end portion of a carton magazine illustrating aspects of the invention.

FIG. 2 is a view of the discharge end 16 of the carton magazine looking upstream from the perspective of the feeder assembly. The feeder assembly and its various components are omitted in FIG. 2 for clarity. A stack of carton blanks 40 is disposed in the carton magazine 12 (FIG. 1) with a forwardmost carton blank 41 having is face exposed at the end 16 of the magazine in position to be selected by the vacuum cups of the feeder assembly. While the carton blanks in this figure are illustrated as simple rectangular blanks for clarity, it will be understood by those of skill in the art that, in most applications, the blanks will be cut and scored to form various flaps, panels, tabs, and the like appropriate for packaging articles such as beverage cans or bottles. The carton blanks typically are made of paperboard, but also may be made of corrugated board or other carton material.

The bottom edge 42 of the forwardmost carton blank 41 is located behind and is held in place by the upstanding tabs 17 at the bottom of the discharge end of the magazine. The tabs 17 may take on a variety of configurations such as, for instance, upstanding tabs formed on a bar as illustrated in FIG. 2, or separate vertical bars that project slightly upwardly into the end of the magazine to engage and capture the bottom edge 42 of the forwardmost carton blank. In any event, the upstanding tabs 17 engage and arrest the forward movement of the bottom edge 42 of the forwardmost carton blank 41 and thereby hold the bottom edge of the stack 40 on the magazine bed. As the chain flights of the magazine move in a downstream direction, the bottoms of the carton blanks are urged together against the upstanding tabs 17 to keep the blanks of the stack tightly packed.

The support shaft 18, embodying principles of this invention, extends across the discharge end 16 of the carton magazine 12 a predetermined distance below the top edges of the carton blanks of the stack 40. The stack of carton blanks lean forward in the waterfall portion of the magazine so that the exposed face of the forwardmost carton blank 41 rests against the support shaft 18. Thus, the upper portion of the stack 40 is supported against the support shaft with the face of the forwardmost carton blank exposed to the feeder assembly in position to be selected from the end of the stack.

The axially displaced cylindrical bosses 27 (FIG. 1) on the ends of the body 26 of the support shaft are rotatably journaled by respective bearings 28 that are mounted within structural supports 29 of the magazine. The cylindrical boss on the right hand side in FIG. 2 extends through its bearing 28 and is operatively coupled to induction motor 31 my means of a coupler sleeve 33. Freewheeling rollers or bushings 20 are rotatably mounted on the body 26 of the support shaft at spaced intervals therealong. As detailed below, the freewheeling rollers are held in place by appropriate clips secured to the body 26 at the ends of the rollers. These clips may be spring clips secured within annular grooves of the body 26, or any other type of clip that maintains the rollers in position along the body 26 and yet allows the rollers to rotate freely about the support shaft body. Balancing kerfs 32 are milled at spaced intervals along the support shaft body on its "high side;" that is, on the side opposite to the direction in which the axes of the bosses 27 are offset from the axis of the support shaft body. The depth and size of the balancing kerfs are predetermined to balance the support shaft 18 as it rotates eccentrically about the axes of the cylindrical bosses and thus to prevent vibration and shaking that might otherwise occur.

During a packaging operation, the induction motor 31 is activated to rotate the support shaft 18 at a relatively high rate, preferably, but not necessarily, in the direction of arrow 35. While a wide variety of rotation rates may be selected, it has been found that a rotation rate of between 1000 and 2000 revolutions per minute (rpm), and preferably about 1500 rpm functions well and represents the best mode of carrying out the invention. The rotation of the support shaft by the motor 31 causes the body of the support shaft, and thus the freewheeling rollers, to move eccentrically or, in other words, to oscillate rapidly back and forth toward and away from the forwardmost carton blank of the stack. As this occurs, the high sides of the freewheeling rollers 20 repeatedly engage the face of the forwardmost blank 41. This has the effect of pushing the upper edge portion of the stack of blanks 40 in an upstream direction just slightly. As the high sides of the rollers rotate past the forwardmost blank, the stack begins to fall back toward the support shaft under the influence of gravity. However, before the stack can fall back into engagement with the support shaft, the high side again rotates around to engage the stack and push it, once again, slightly upstream. As a result of this action, the face of the forwardmost blank 41 is out of engagement with the freewheeling rollers 20 for a great majority of the time and is only in contact with the rollers briefly as their high sides rotate around to engage and push the stack slightly backward. It has been estimated that the face of the forwardmost blank 41 remains out of contact with the rollers for as much as ninety percent (90%) or more of the time, although this figure might be more or less depending upon numerous factors such as rotation rate of the support shaft, the weight of the stack, etc.

As a consequence of the forgoing action, the average friction between the face of the forwardmost blank 41 and the support shaft 18 is greatly reduced relative to the friction encountered with prior art tabs, clips, or bars. Furthermore, the freewheeling rollers 20, since they rotate in a downward direction when impacting the forwardmost blank 41, impart a slight downward force to the forwardmost blank due to momentum and rotational resistance of the rollers themselves. This helps to keep the bottom edge of the forwardmost blank properly aligned and seated against the upstanding tabs 17 before it is selected. Furthermore, as detailed below, the slight downward force imparted to the forwardmost blank assists the vacuum cups to slide the forwardmost blank downwardly from beneath the support shaft and off of the stack 40 when the forwardmost blank is selected. Finally, it has been found that the vibration imparted to the stack 40 by the eccentrically rotating support shaft 18 helps to "shake down" the stack, eliminating air between the blanks, keeping the blanks properly aligned, and generally improving the efficiency of the selection operation.

Figure 3:
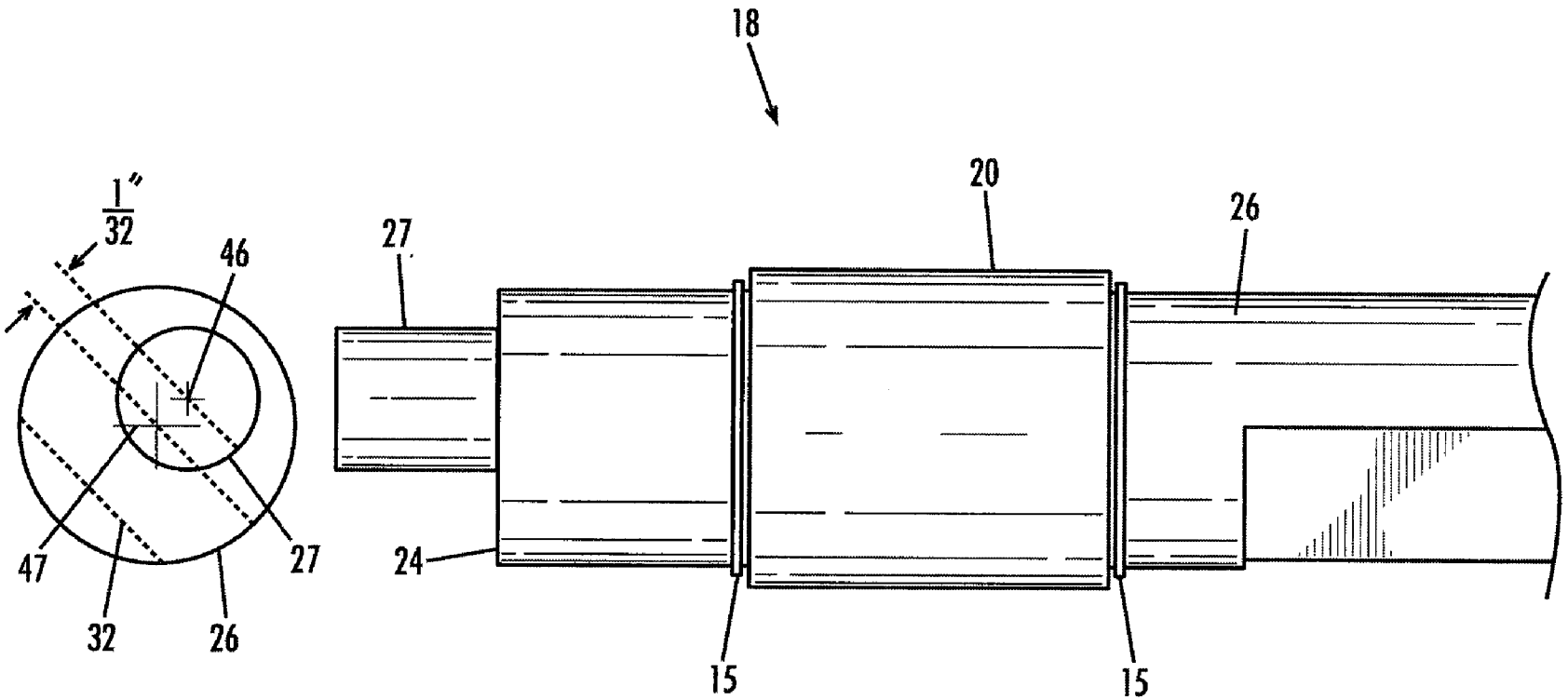
FIG. 3 is a side elevational view, with end view projection, showing the support shaft, rollers, and cylindrical bosses of the support shaft assembly according to aspects of the invention.

FIG. 3 illustrates a preferred construction of the support shaft in greater detail. The relative sizes of some of the components shown in FIG. 3 have been exaggerated for clarity of description. For example, the diameter of the cylindrical boss 27 relative to that of the support shaft body 26 has been exaggerated, as has the offset between the axis of the cylindrical boss and the axis of the support shaft body. In reality, the diameters of the support shaft body and the cylindrical boss are closer to the same, and the offset of the axes is small, 1/32 of an inch in the preferred embodiment, but large enough to realize the advantages of the present invention.

The support shaft 18 has an elongated generally cylindrical body 26 with an axis 47 and ends 24, only one of which is visible in FIG. 3. A cylindrical boss 27 projects from the end 25 of the body 26 and has an axis 46. It will be understood that a similar cylindrical boss projects from the opposite end of the body 26 and also has an axis. The axis 46 of the cylindrical boss 27 is radially offset from the axis 47 of the support shaft body 26. In the illustrated embodiment, the offset is relatively small, 1/32 of an inch; however, this particular offset is not a limitation of the invention and other offsets may be selected by skilled artisans. Further, the cylindrical boss on the opposite end of the body 26 is offset by the same amount and in the same radial direction relative to the axis 47 of the body 26. In other words, the axes of the cylindrical bosses at each end of the support shaft body 26 are offset equally and are coextensive with each other.

With the just described configuration, it will be seen that when the cylindrical bosses are journaled within their bearings as described above and one is rotated by induction motor 31, the body 26 rotates eccentrically about the coextensive axes of the cylindrical bosses. Thus, the surface of the body 26 wobbles or follows an oscillating path as a result of its rotation. Balancing kerfs 32 are milled at spaced intervals along the high side of the support shaft body 26; that is, along the side radially opposite to the direction in which the axes of the cylindrical bosses are offset from the axis of the body 26. The amount of material removed from the body in the balancing kerfs is predetermined so that the eccentrically rotating support shaft is balanced and does not shake as it rotates at relatively high rates. Freewheeling rollers 20 are rotatably mounted on the support shaft body 26 at spaced intervals, preferably in between the balancing kerfs. The rollers, which may be metal or plastic bushings, are retained in position on the body by appropriate retainer clips, such as ring clips 15 in the illustrated embodiment.

Figure 4A:
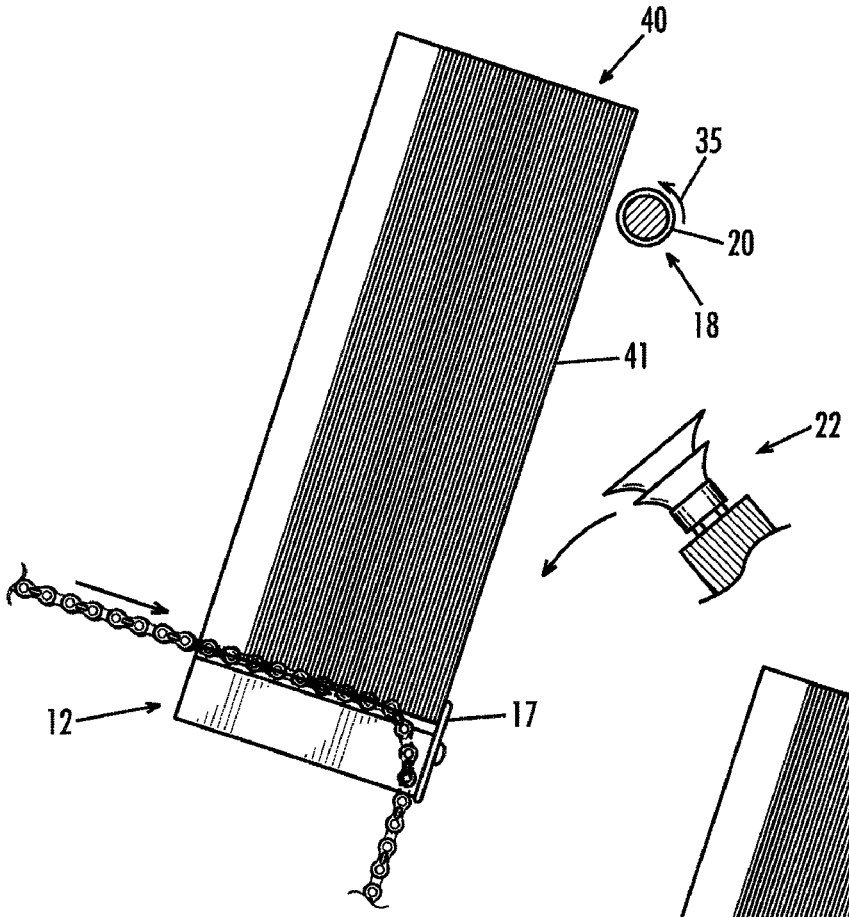
FIGS. 4*a*-4*d* illustrate, sequentially, a carton blank being picked or selected from the end of a stack of blanks in a system wherein the present invention is employed.

FIGS. 4*a* through 4*d* illustrate sequentially the operation of the support shaft 18 of this invention as forwardmost carton blanks are selected and removed by the feeder assembly from the stack for delivery to downstream stations of a packaging machine. FIG. 4*a* shows a stack 40 of carton blanks at the end of magazine 12 with the forwardmost blank 41 of the stack being exposed for selection and being supported along its bottom edge by upstanding tabs 17. Support bar 18, carrying freewheeling rollers 20, extends across the end of the magazine spaced a predetermined distance down from the top edge of the forwardmost carton blank 41. The support shaft 18 is being rotated by motor 31 (not shown) eccentrically in direction 35 and, as a result of its rotation, the rollers 20 disposed about the body of the support shaft oscillate rapidly back and forth toward and away from the forwardmost blank 41 of the stack 40. As described above, this causes the surface of the forwardmost blank to be out of contact with the rollers 20 for a great majority of the time. Vacuum cup 22 of the feeder assembly is shown approaching the forwardmost blank 41 for selecting the forwardmost blank and removing it from the front of the stack.

Figure 4B:
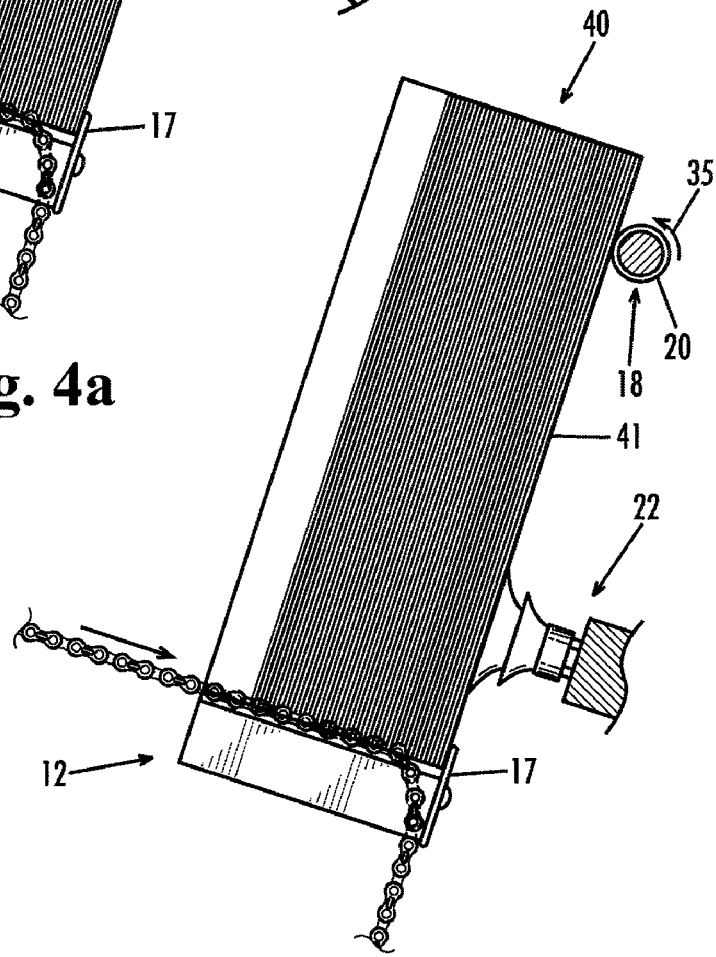

In FIG. 4*b*, the vacuum cup 22 rotates into engagement with the face of the forwardmost blank 41, in this case near its bottom edge portion, and the controller of the packaging machine applies an appropriate vacuum to cause the suction cup to stick or adhere to the face of the forwardmost blank. The support shaft 18 continued to rotate eccentrically as described, reducing greatly the friction between the face of the forwardmost blank and the support shaft.

Figure 4C:
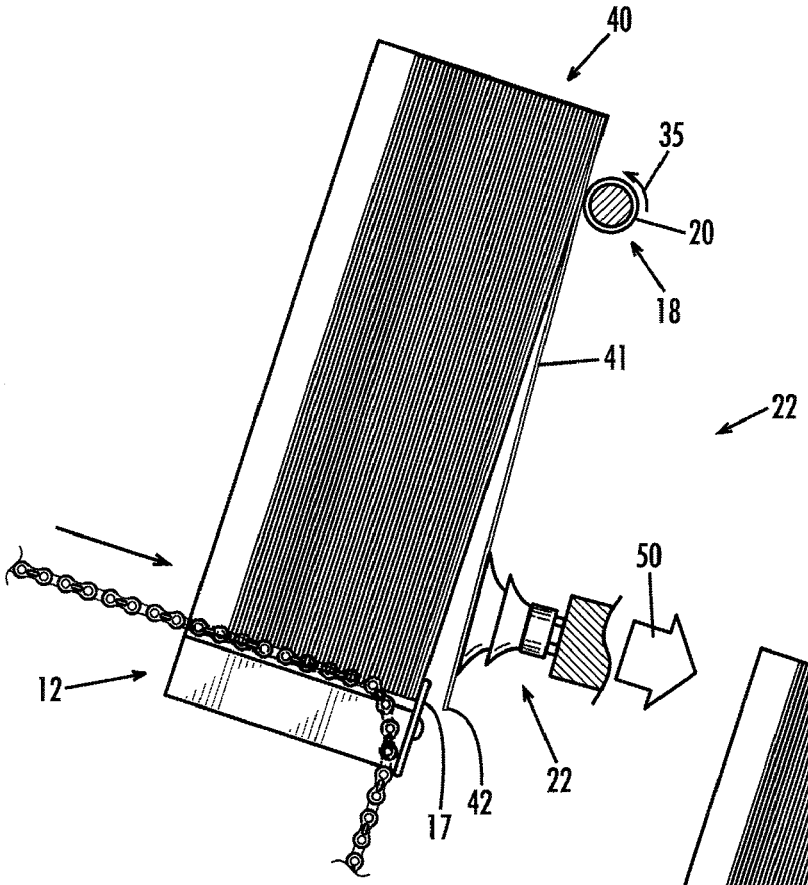

In FIG. 4*c*, the feeder assembly next withdraws the vacuum cup a short distance in the direction of arrow 50 substantially perpendicular to the face of the forwardmost blank and along the axis of the vacuum cup. This, in turn, pulls the bottom edge 42 of the forwardmost blank from behind the upstanding tabs 17 that previously held the bottom edge in place. The next blank of the stack falls in behind the clips 17. The support shaft continues to rotate so that the friction between the surface of the forwardmost blank 41 and the support shaft continues to be minimized.

Figure 4D:
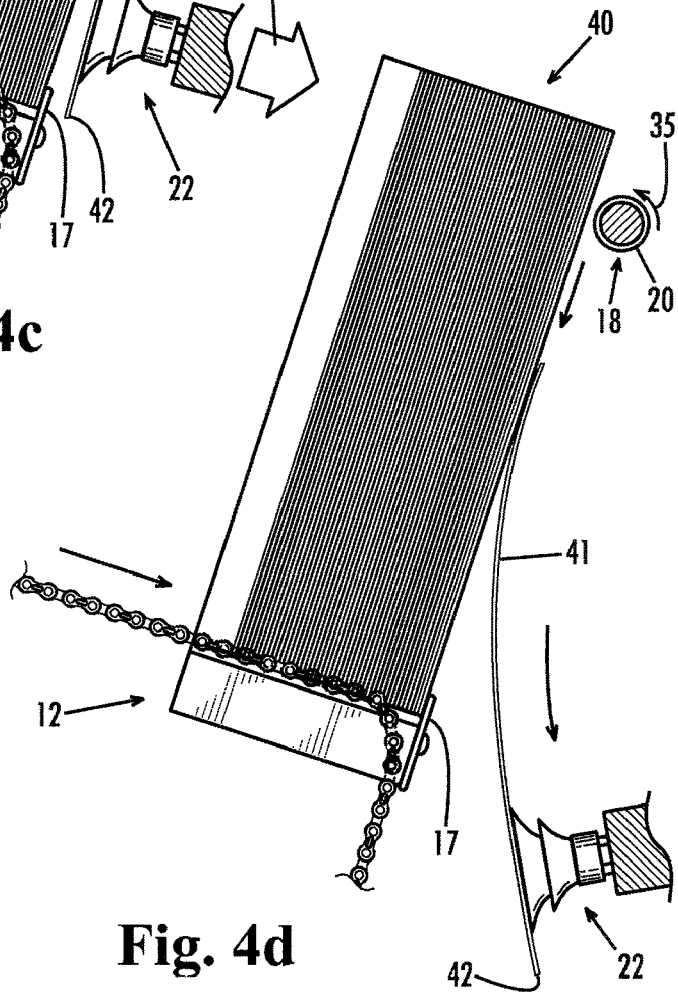

In FIG. 4*d*, the feeder assembly rotates the vacuum cup downwardly with a vacuum still applied to the vacuum cup by the vacuum system. In prior art systems, this is the point at which the vacuum cups sometimes would slip off of the face of the forwardmost blank due to the shear forces on the cup caused by overcoming friction between the blank and the support structure (clips, tabs, or bars) supporting the top portion of the blank. However, with the present invention, the friction between the support shaft 18 and the face of the forwardmost blank 41 is minimized. In fact, it has been found that, with the support shaft and its rollers rotating in direction 35, the rollers impacting the face of the blank impart a small downward force to the blank. Accordingly, the support shaft of this invention actually assist the vacuum cups to slide the forwardmost blank off of the stack and from beneath the support shaft. As a result, instances of machine jams as a result of the vacuum cups slipping off of blanks during a packaging operation are greatly reduced or eliminated.

The sequence illustrated in FIGS. 4*a* through 4*d* is repeated in rapid succession to select carton blanks from the stack and feed or deliver them to downstream workstations of the packaging machine, as described in detail in the incorporated U.S. Pat. No. 6,550,608.

The invention has been described herein in terms of preferred embodiments and methodologies considered by the inventors to represent the best mode of carrying out the invention. It will be clear to skilled artisans, however, that many modifications might be made to the illustrated embodiments within the scope of the invention. For example, while an eccentrically rotating cylindrical body has been illustrated and described herein, equivalent results may be obtained by, for instance, a concentrically rotating body having a slightly oval or oblong cross section; although, in such a configuration, it is believed that freewheeling rollers would be difficult to implement successfully. In another example, a concentrically rotating cylindrical body might be provided with a ridge, bumps, or rollers along one side that engage the surface of the forwardmost blank as the body is rotated. Thus, eccentricity of rotation is not necessarily are requirement of the present invention. Further, the support shaft assembly and methodology has been illustrated herein within the context and used with a particular type of rotary feeder assembly. It should be understood that the invention certainly is not limited to a rotary feeder, or to any particular type of feeder, or to feeders with vacuum cups used to select carton blanks. For example, the support shaft and methodology of the invention is equally applicable to a segment wheel type feeder assembly or, indeed, any feeder assembly where a stack of carton blanks is supported at an end from which blanks are selected or picked. More broadly, the invention applies to industries other than the packaging industry in any situation where a stack of substantially flat items needs to be supported with reduced friction between the support and the items. Finally, while an electric induction motor has been described as the preferred means of driving the pusher assembly, it will be understood that any appropriate drive, such as, for instance, a pneumatic or hydraulic drive, or a drive mechanism linked to another shaft, my be substituted with equivalent results. These and other additions, deletions, and modifications might well be made to the embodiments illustrated herein without departing from the spirit and scope of the invention, which is defined only by the claims hereof.

What is claimed is:

1. A carton feeder for an article packaging machine comprising:

a magazine having an upstream end and a downstream end and being configured to receive a stack of carton blanks and to convey a received stack toward the downstream end of the magazine;

a selector adjacent the downstream end of the magazine configured to select and remove individual carton blanks from a forwardmost end of a stack of carton blanks at the downstream end of the magazine;

a support shaft positioned at the downstream end of the magazine, the support shaft being positioned to support a stack of carton blanks with the forwardmost carton blank of a supported stack in position for selection by the selector, the support shaft being rotatable at a rate of between 1000 and 2000 revolutions per minute and having a surface that oscillates toward and away from the upstream end of the magazine as the support shaft rotates, and wherein the support shaft comprises an elongated generally cylindrical body defined about a support shaft body axis and extending across the downstream end of the magazine, the generally cylindrical body being rotatable eccentrically about an axis offset from the support shaft body axis.

2. A carton feeder for an article packaging machine as claimed in claim 1, wherein the cylindrical body has opposing ends, and wherein the carton feeder further comprises a cylindrical boss projecting from each end of the support shaft body, each cylindrical boss being journaled by a bearing and having an axis offset from the support shaft body axis.

3. A carton feeder for an article packaging machine as claimed in claim 2 and wherein the axes of the cylindrical bosses are aligned with each other.

4. A carton feeder for an article packaging machine as claimed in claim 3 and wherein at least one of the cylindrical bosses is driven to rotate the support shaft.

5. A carton feeder for an article packaging machine comprising:

a magazine having an upstream end and a downstream end and being configured to receive a stack of carton blanks and to convey a received stack toward the downstream end of the magazine;

a selector adjacent the downstream end of the magazine configured to select and remove individual carton blanks from a forwardmost end of a stack of carton blanks at the downstream end of the magazine;

a support shaft extending across the downstream end of the magazine, the support shaft being positioned to support a stack of carton blanks with the forwardmost carton blank of a supported stack in position for selection by the selector;

the support shaft being rotatable and having a surface that oscillates toward and away from the upstream end of the magazine as the support shaft rotates, and wherein the support shaft is milled along its length to balance the support shaft as the support shaft is rotated.

6. A carton feeder for an article packaging machine comprising:

a magazine having an upstream end and a downstream end and being configured to receive a stack of carton blanks and to convey a received stack toward the downstream end of the magazine;

a selector adjacent the downstream end of the magazine configured to select and remove individual carton blanks from a forwardmost end of a stack of carton blanks at the downstream end of the magazine;

a support structure disposed at the downstream end of the magazine, the support structure being positioned to support a stack of carton blanks with the forwardmost carton blank of a supported stack in position for selection by the selector;

the support structure including a carton blank engagement surface that oscillates toward and away from the upstream end of the magazine; and a drive assembly operably connected to the carton blank engagement surface and configured to oscillate the engagement surface at a rate sufficient to cause the forwardmost carton blank of a supported stack to be engaged repeatedly by the carton blank engagement surface and to be out of engagement with the carton blank engagement most of the time that oscillation is in effect.

7. The carton feeder as claimed in claim 6, and wherein the magazine is structured to support carton blanks on their edges.

8. The carton feeder of claim 6, wherein the support structure includes a rotatable portion on which is defined or mounted the carton blank engagement surface, and wherein the drive assembly is configured to rotate the rotatable portion.

9. The carton feeder as claimed in claim 8, and wherein, when viewed from the upstream end of the magazine, the rotatable portion exhibits a downward rotation.

10. The carton feeder of claim 9, wherein the drive assembly is configured to rotate the rotatable portion at a rate of between 1000 and 2000 revolutions per minute.

11. The carton feeder of claim 6, wherein the drive assembly is configured to oscillate the engagement surface at a rate sufficient to cause the forwardmost carton blank of a supported stack to be engaged repeatedly by the carton blank engagement surface and to be out of engagement with the carton blank engagement surface during ninety percent (90%) or more of the time that oscillation is in effect.

12. The carton feeder of claim 6, wherein the support structure includes a rotatable portion on which is defined or mounted the carton blank engagement surface, the drive assembly is configured to rotate the rotatable portion, and the rotatable portion of the support structure comprises a shaft having ends.

13. The carton feeder of claim 6, wherein the support structure includes a rotatable portion on which is defined or mounted the carton blank engagement surface, the drive assembly is configured to rotate the rotatable portion, and the engagement surface comprises rollers mounted on the rotatable portion.

14. A carton feeder for an article packaging machine comprising:

a magazine having an upstream end and a downstream end and being configured to receive a stack of carton blanks and to convey a received stack toward the downstream end of the magazine;

a selector adjacent the downstream end of the magazine configured to select and remove individual carton blanks from a forwardmost end of a stack of carton blanks at the downstream end of the magazine;

a support structure disposed at the downstream end of the magazine, the support structure being positioned to support a stack of carton blanks with the forwardmost carton blank of a supported stack in position for selection by the selector, the support structure including a carton blank engagement surface that oscillates toward and away from the upstream end of the magazine; and a drive assembly operably connected to the carton blank engagement surface and configured to oscillate the engagement surface at a rate sufficient to cause any carton blank, in a position to be engaged by the engagement surface when oscillation is not in effect, to be out of engagement with the surface most of the time that oscillation is in effect, wherein the support structure includes a rotatable portion on which is defined or mounted the carton blank engagement surface, wherein the drive assembly is configured to rotate the rotatable portion, and wherein the rotatable portion of the support structure comprises a shaft having ends.

15. A carton feeder as claimed in claim 14 and wherein the shaft is generally cylindrical about a shaft axis.

16. A carton feeder as claimed in claim 15 and wherein the shaft is mounted for rotation about an axis offset from the shaft axis.

17. A carton feeder as claimed in claim 16 and further comprising a cylindrical boss projecting from each end of the shaft, each cylindrical boss being rotatably journaled in a bearing.

18. A carton feeder as claimed in claim 17 and wherein each cylindrical boss has an axis, the axes of the cylindrical bosses being coextensive and offset a predetermined distance from the shaft axis.

19. A carton feeder as claimed in claim 18 and wherein the drive assembly comprises a motor coupled to one of the cylindrical bosses for rotating the rotatable portion of the support structure.

20. A carton feeder for an article packaging machine comprising:

a magazine having an upstream end and a downstream end and being configured to receive a stack of carton blanks and to convey a received stack toward the downstream end of the magazine;

a selector adjacent the downstream end of the magazine configured to select and remove individual carton blanks from a forwardmost end of a stack of carton blanks at the downstream end of the magazine;

a support structure disposed at the downstream end of the magazine, the support structure being positioned to support a stack of carton blanks with the forwardmost carton blank of a supported stack in position for selection by the selector, the support structure including a carton blank engagement surface that oscillates toward and away from the upstream end of the magazine; and a drive assembly operably connected to the carton blank engagement surface and configured to oscillate the engagement surface at a rate sufficient to cause any carton blank, in a position to be engaged by the engagement surface when oscillation is not in effect, to be out of engagement with the surface most of the time that oscillation is in effect, wherein the support structure includes a rotatable portion on which is defined or mounted the carton blank engagement surface, wherein the drive assembly is configured to rotate the rotatable portion, and wherein the engagement surface comprises rollers mounted on the rotatable portion.

21. A method of supporting a stack of items at a downstream end of a magazine, the method comprising the steps of:

(a) supporting the stack of items by a support structure disposed at the downstream end of the magazine; and (b) oscillating a portion of the support structure toward and away from the stack of items in such a manner that the oscillating portion of the support structure repeatedly engages the forwardmost item in the stack and the forwardmost item in the stack is out of engagement with the portion of the support structure most of the time that the oscillation is in effect.

22. The method of claim 21 and wherein the support structure includes a shaft and the method further comprises rotating the shaft and thereby effecting the oscillating step.

23. The method of claim 22 and wherein the shaft has a shaft axis and wherein the oscillating step includes rotating the shaft about an axis offset a predetermined distance from the shaft axis.

24. The method of claim 21, wherein the oscillating step includes oscillating the portion at a rate of between 1000 and 2000 cycles per minute.

25. A feeder for feeding substantially flat articles sequentially from the end of a stack of such articles to a workstation displaced from the stack of articles, the feeder comprising:

a magazine having an upstream end and a downstream end and being configured to receive a stack of articles and to convey a received stack in a first direction toward the downstream end of the magazine;

a selector adjacent the downstream end of the magazine configured to select individual articles from a forwardmost end of a stack of articles at the downstream end of the magazine, and to move the selected articles in a second direction, different from the first direction, for delivery to the workstation;

a support structure disposed at the downstream end of the magazine, the support structure being positioned to support a stack of articles with the forwardmost article of a supported stack in position for selection by the selector, the support structure comprising an article engagement surface that moves through a path resulting in at least movement of the surface toward and away from the upstream end of the magazine and movement of the surface parallel to the second direction; and a drive assembly operably connected to the article engagement surface and configured to move the article engagement surface in such a manner that, while that movement is in effect, a forwardmost article of a supported stack in the magazine is repeatedly engaged by the surface and remains out of contact with the surface between repeated contacts.

26. The feeder of claim 25 and wherein the articles comprise carton blanks.

27. The feeder of claim 25, wherein the engagement surface comprises a rotating surface.

28. The carton feeder as claimed in claim 25, and wherein the magazine is structured to support carton blanks on their edges.

29. A feeder for feeding substantially flat articles sequentially from the end of a stack of such articles to a workstation displaced from the stack of articles, the feeder comprising:

a magazine having an upstream end and a downstream end and being configured to receive a stack of articles and to convey a received stack in a first direction toward the downstream end of the magazine;

a selector adjacent the downstream end of the magazine configured to select individual articles from a forwardmost end of a stack of articles at the downstream end of the magazine, and to move the selected articles in a second direction, different from the first direction, for delivery to the workstation;

a support structure disposed at the downstream end of the magazine, the support structure being positioned to support a stack of articles with the forwardmost article of a supported stack in position for selection by the selector, the support structure comprising an article engagement surface that moves through a path resulting in at least movement of the surface toward and away from the upstream end of the magazine and movement of the surface parallel to the second direction; and a drive assembly operably connected to the article engagement surface and configured to move the article engagement surface in such a manner that, while that movement is in effect, any article, in a position to be contacted by the contacting surface when movement is not in effect, is only intermittently in contact with the surface and remains out of contact with the surface between intermittent contacts, wherein the engagement surface comprises a bearing surface mounted for freewheeling movement on a rotating surface, which rotating surface is mounted to a shaft for offset rotation.

30. A carton feeder for an article packaging machine comprising:

a magazine having an upstream end and a downstream end and being configured to receive a stack of carton blanks and to convey a received stack toward the downstream end of the magazine;

a selector adjacent the downstream end of the magazine configured to select and remove individual carton blanks from a forwardmost end of a stack at the downstream end of the magazine; and a support structure disposed at the downstream end of the magazine, the support structure being positioned to support a stack of carton blanks with the forwardmost carton blank of a supported stack in position for selection by the selector, the support structure including a carton blank engagement surface that oscillates toward and away from the upstream end of the magazine; and a drive assembly operably connected to the carton blank engagement surface and configured to oscillate the engagement surface at a rate sufficient to cause the carton blank engagement surface to repeatedly engage the forwardmost carton blank of a supported stack and to be out of engagement with the forwardmost carton blank of a supported stack during ninety percent (90%) or more of the time that oscillation is in effect.

31. A method of supporting a stack of items at a downstream end of a magazine, the method comprising the steps of:

(a) supporting the stack of items by a support structure disposed at the downstream end of the magazine; and (b) oscillating a portion of the support structure toward and away from the stack of items in such a manner that the oscillating portion of the support structure repeatedly engages the forwardmost item in the stack when oscillation is in effect, and the forwardmost item in the stack is out of engagement with the support structure during ninety percent (90%) or more of the time that oscillation is in effect.

* * * * *